US011548751B2

(12) United States Patent
Kinoshita et al.

(10) Patent No.: US 11,548,751 B2
(45) Date of Patent: Jan. 10, 2023

(54) POSTPROCESSING APPARATUS AND IMAGE FORMING SYSTEM

(71) Applicant: FUJIFILM Business Innovation Corp., Tokyo (JP)

(72) Inventors: Shoya Kinoshita, Kanagawa (JP); Jun Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/401,677

(22) Filed: Aug. 13, 2021

(65) Prior Publication Data

US 2022/0371850 A1 Nov. 24, 2022

(30) Foreign Application Priority Data

May 21, 2021 (JP) ..... JP2021-086299

(51) Int. Cl.
*B65H 37/04* (2006.01)

(52) U.S. Cl.
CPC ..... *B65H 37/04* (2013.01); *B65H 2408/1222* (2013.01)

(58) Field of Classification Search
CPC ..... B65H 37/04; B65H 2301/43828; B65H 2301/51616; B65H 2408/1222; B31F 1/07; B31F 5/001; B31F 5/02; B31F 2201/07; G03G 2215/00827; G03G 2215/00852; G03G 2215/00864; G03G 15/6544
See application file for complete search history.

(56) References Cited

U.S. PATENT DOCUMENTS

| | | | | |
|---|---|---|---|---|
| 7,063,248 | B2 * | 6/2006 | Noh | G03G 15/6573 227/111 |
| 8,297,610 | B2 * | 10/2012 | Shiraishi | B42B 5/00 270/58.11 |
| 8,540,228 | B2 * | 9/2013 | Shiraishi | B42B 5/00 270/58.08 |
| 10,059,025 | B2 * | 8/2018 | Baek | B31F 5/001 |
| 10,481,542 | B2 * | 11/2019 | Kobayashi | G03G 15/6541 |
| 10,577,216 | B2 * | 3/2020 | Kobayashi | B42B 5/00 |
| 10,981,747 | B2 * | 4/2021 | Kobayashi | B42B 5/00 |

FOREIGN PATENT DOCUMENTS

JP 2020-40738 A 3/2020

* cited by examiner

*Primary Examiner* — Leslie A Nicholson, III
(74) *Attorney, Agent, or Firm* — Oliff PLC

(57) ABSTRACT

A postprocessing apparatus includes: a first postprocessing member that performs postprocessing on a recording medium; a second postprocessing member that differs from the first postprocessing member and performs postprocessing on the recording medium; a mounting base to which the first and second postprocessing members are mounted; a support plate having a guide member that guides movement of the mounting base; and a moving mechanism that moves the mounting base along the guide member.

7 Claims, 11 Drawing Sheets

POSTPROCESSING APPARATUS AND IMAGE FORMING SYSTEM

CROSS-REFERENCE TO RELATED APPLICATIONS

This application is based on and claims priority under 35 USC 119 from Japanese Patent Application No. 2021-086299 filed May 21, 2021.

BACKGROUND

(i) Technical Field

The present disclosure relates to a postprocessing apparatus and an image forming system.

(ii) Related Art

Japanese Unexamined Patent Application Publication No. 2020-040738 discloses a postprocessing apparatus that performs binding processing on a recording material according to a binding instruction, and an image forming system. The postprocessing apparatus includes a first binding unit that is provided so as to be able to move along a moving path and performs first binding processing, a second binding unit that is provided so as to be able to move along the moving path and performs second binding processing that differ from the first binding processing, and a control unit that controls the movement of the first binding unit and the second binding unit.

In this postprocessing apparatus having two postprocessing members, the postprocessing members are provided independently and, thus, each require a driving system, a control system, and the like for operating the postprocessing member. Furthermore, a guide member for guiding the movement of the two postprocessing members needs to have a branch path, to which the postprocessing member that is not in use is retracted.

SUMMARY

Aspects of non-limiting embodiments of the present disclosure relate to providing a postprocessing apparatus in which two postprocessing members are moved by a common moving mechanism, and an image forming system.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a postprocessing apparatus including: a first postprocessing member that performs postprocessing on a recording medium; a second postprocessing member that differs from the first postprocessing member and performs postprocessing on the recording medium; a mounting base to which the first and second postprocessing members are mounted; a support plate having a guide member that guides movement of the mounting base; and a moving mechanism that moves the mounting base along the guide member.

BRIEF DESCRIPTION OF THE DRAWINGS

Exemplary embodiments of the present disclosure will be described in detail based on the following figures, wherein.

DETAILED DESCRIPTION

Figure 1:
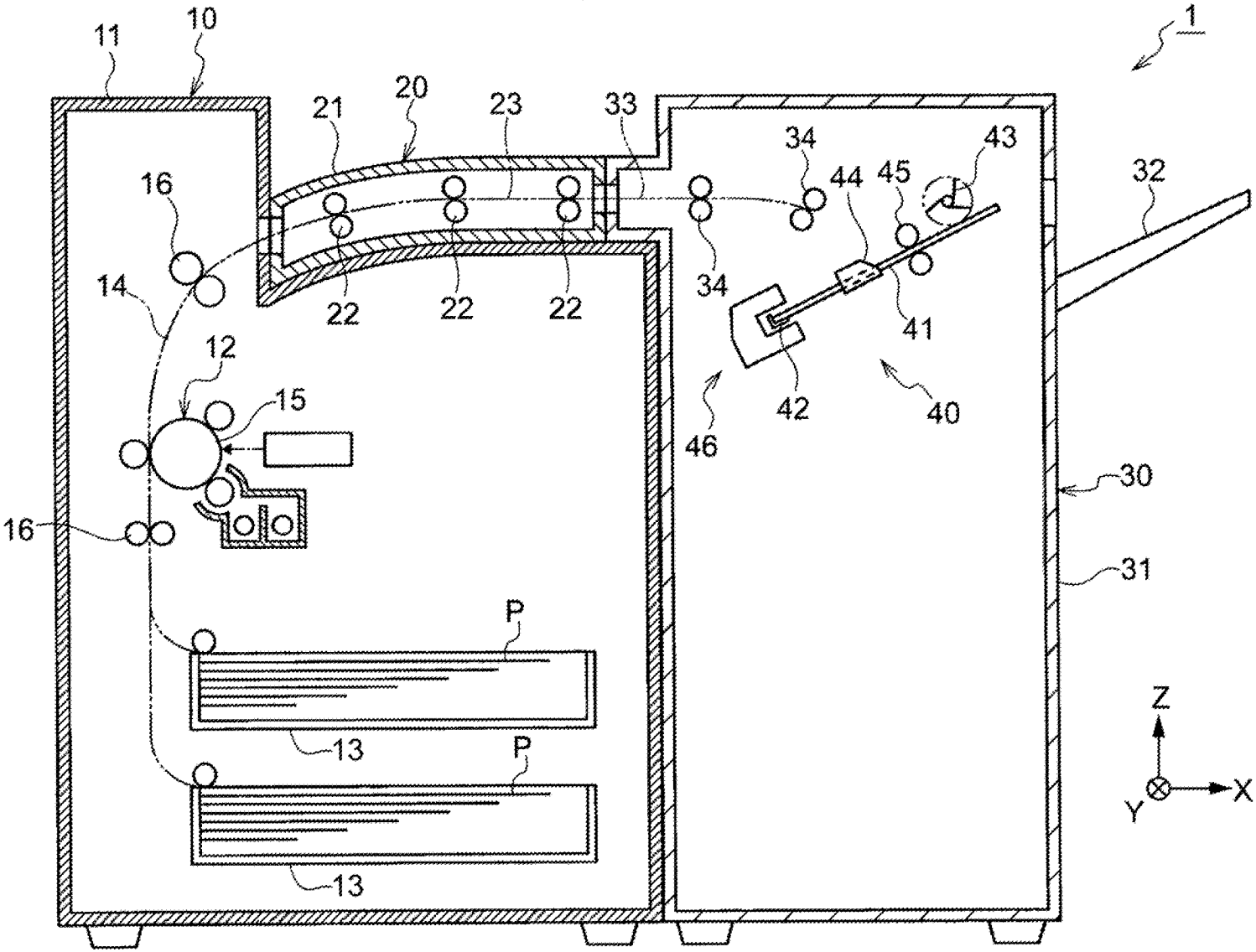
FIG. 1 schematically shows an example of an image forming system according to a first exemplary embodiment of the present disclosure.

Referring to the drawings, exemplary embodiments for implementing the present disclosure will be described below. In the description below, the range necessary for the explanation for achieving the purpose of the present disclosure will be schematically shown, and the range necessary for the explanation of that part of the present disclosure will be described below. A known technique may be applied to the portions that are not explained.

First Exemplary Embodiment

FIG. 1 schematically shows an example of an image forming system 1 according to a first exemplary embodiment of the present disclosure. The image forming system 1 according to this exemplary embodiment may include an image forming unit 10, a transport unit 20, and a postprocessing unit 30. In the description below, the X, Y, and Z directions in FIG. 1 correspond to the horizontal, depth, and height directions, respectively. The image forming unit 10 is an example of an image forming apparatus, and the postprocessing unit 30 is an example of a postprocessing apparatus.

The image forming unit 10 may include an image forming unit body 11. The image forming unit body 11 may accommodate, therein, an image forming part 12 and two sheet storage parts 13. The image forming unit body 11 may also accommodate a transport path 14.

The image forming part 12 forms an image on a sheet P, serving as an example of a recording medium. The image forming part 12 can form an image on a sheet P through an electrophotographic system, in which a toner image preliminarily formed on a photoconductor drum 15 is transferred to the sheet P. The image forming method used by the image forming part 12 is not limited to the electrophotographic system, but may be, for example, an ink jet method, in which ink is discharged onto a sheet P. Although a typical sheet P is paper, other materials on which printing can be performed, such as other film-like materials, may also be used.

The two sheet storage parts 13 each store a stack of sheets P of different sizes and types. The sheets P stored in the sheet storage parts 13 are supplied one-by-one to the image forming part 12. The number of the sheet storage parts 13 is not limited to two, but may be one, or three or more.

The transport path 14 is a path along which a sheet P is transported to an intended position in the image forming unit 10 and along which the sheet P supplied from a sheet storage part 13 and subjected to image formation in the image forming part 12 is discharged to the outside of the image forming unit body 11. Multiple transport rollers 16 are provided at certain positions in the transport path 14.

The transport unit 20 includes a transport unit body 21 and multiple transport rollers 22 provided in the transport unit body 21. The transport unit 20 is disposed so as to connect a sheet output port of the image forming unit 10 and a sheet inlet of the postprocessing unit 30 and accommodates a transport path 23, along which the sheet P discharged from the image forming unit 10 is transported into a postprocessing unit body 31. A punching device (not shown) that provides a hole in the sheet P may be provided in the transport unit 20.

The postprocessing unit 30 includes the postprocessing unit body 31 and a binding unit 40 disposed in the postprocessing unit body 31. The binding unit 40 binds multiple sheets P together into a paper bundle PB (see FIG. 5). An output part 32, on which the sheet P or the paper bundle PB formed in the binding unit 40 is discharged, is attached to the postprocessing unit body 31. A transport path 33 having multiple transport rollers 34 is formed in the postprocessing unit body 31, and a sheet P transported into the postprocessing unit body 31 is transported to the binding unit 40 along the transport path 33.

The binding unit 40 may include a loading plate 41, an abutting member 42, a paddle 43, tampers 44, a discharging roller 45, and a binding device 46. The loading plate 41 may be a plate-like member on which a sheet P transported from the transport path 33 is placed. The loading plate 41 may be inclined at an angle (for example, about 30°) with respect to the horizontal direction such that the end thereof closer to the abutting member 42 is lower than the other end in the height direction. Multiple sheets P may be placed on the top surface of the loading plate 41. The overall binding unit 40, including the loading plate 41, is also inclined at an angle with respect to the horizontal direction, correspondingly. The abutting member 42, against which the trailing ends of multiple sheets P in the transport direction abut, aligns the multiple sheets P in the transport direction. The paddle 43 is provided above the loading plate 41 and is rotated by receiving a driving force from a driving source (not shown) to urge the sheets P toward the abutting member 42. The tampers 44 are movable in a direction (hereinbelow, also "sheet width direction") intersecting the transport direction of the multiple sheets P in the depth direction. By moving the tampers 44 so as to sandwich the sheets P in the sheet width direction, the multiple sheets P (paper bundle PB) are aligned in the width direction. The discharging roller 45 can operate so as to discharge the paper bundle PB formed by the binding device 46 (described below) to the output part 32.

Figure 2:
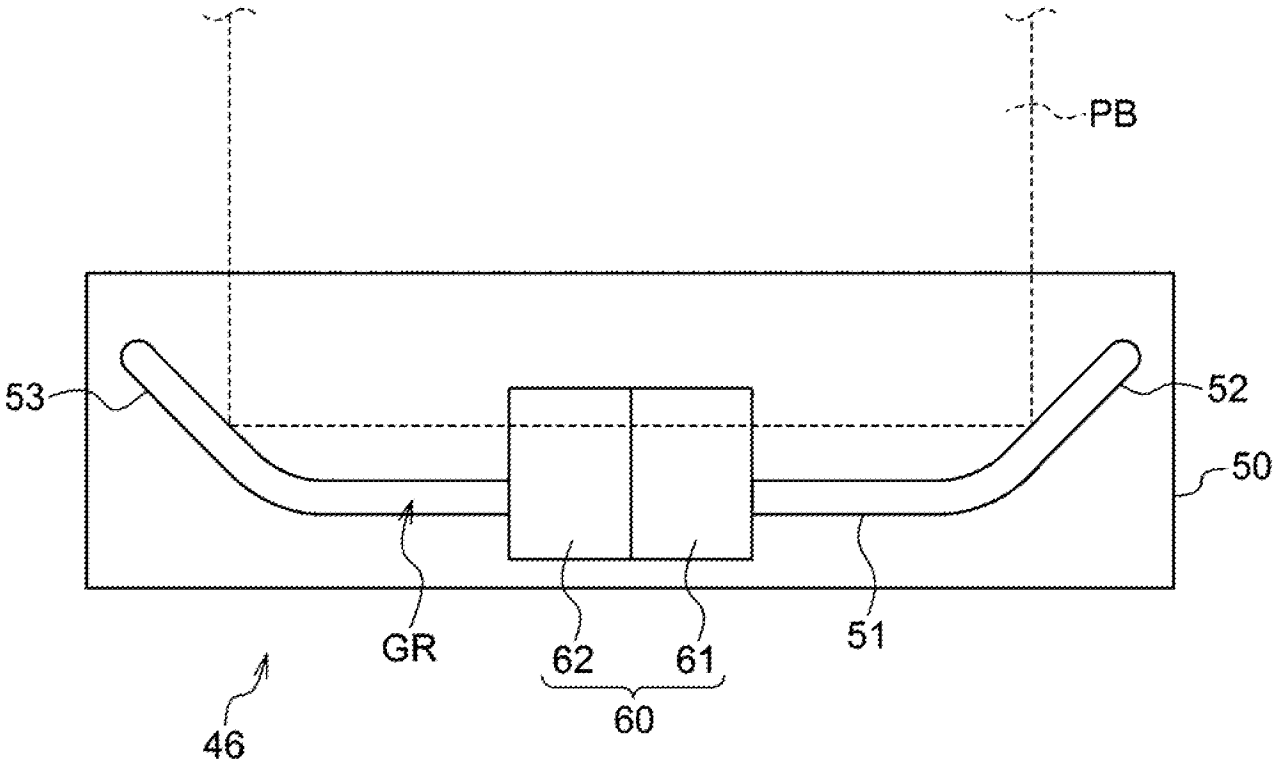
FIG. 2 is a schematic plan view of a binding unit of the image forming system in FIG. 1.

FIG. 2 is a schematic plan view of the binding unit 40 of the image forming system 1 in FIG. 1. In FIG. 2, for ease of understanding of the structure of the binding device 46, the loading plate 41 and the like for supporting sheets P are not illustrated. As described above, although the overall binding unit 40 is inclined at an angle with respect to the horizontal direction, in FIG. 2, a surface viewed from a direction perpendicular to the direction in which the inclined binding unit 40 extends is illustrated as a horizontal surface. As shown in FIG. 2, the binding device 46 of the binding unit 40 according to this exemplary embodiment can perform multiple types of binding processing, which are examples of first and second postprocessing, on one or multiple locations at one end of the multiple sheets P (i.e., the paper bundle PB) placed on the loading plate 41, the end closer to the abutting member 42. The binding device 46 may include a support plate 50 having an elongated-hole-shaped guide rail GR, and a moving body unit 60 that moves on the support plate 50. The guide rail GR is an example of a guide member.

The support plate 50 may be a rectangular member elongated in the depth direction in plan view. The guide rail GR is a long hole penetrating through the support plate 50 in the vertical direction. The guide rail GR may include a principal guide path 51 extending in the depth direction along one edge of a sheet P, a first bent path 52 extending in the transport direction so as to be bent from the near end of the principal guide path 51, and a second bent path 53 extending in the transport direction so as to be bent from the far end of the principal guide path 51. The first and second bent paths 52 and 53 are an example of a rotation member that rotates a mounting base 63 (see FIG. 3) of the moving body unit 60 (described below).

Figure 3:
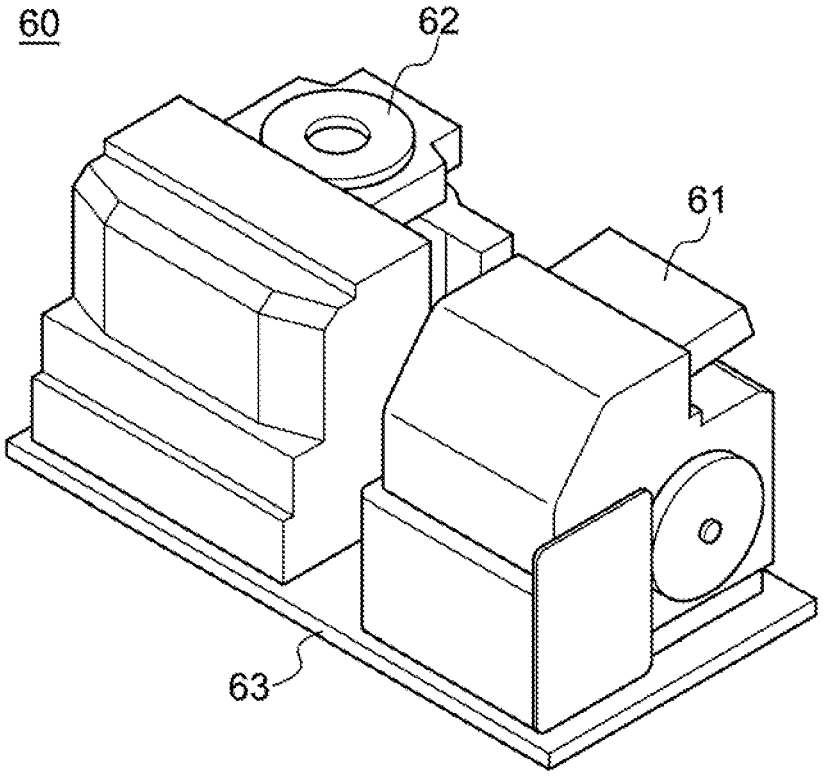
FIG. 3 is a schematic perspective view of a moving body unit shown in FIG. 2.

FIG. 3 is a schematic perspective view of the moving body unit 60 shown in FIG. 2. The moving body unit 60 includes: a staple binding member 61, which binds multiple sheets P together using a staple; a stapleless binding member 62, which binds multiple sheets P together without a staple; and the mounting base 63 to which the staple binding member 61 and the stapleless binding member 62 are mounted. The staple binding member 61 and the stapleless binding member 62 are arranged side-by-side on the top surface of the mounting base 63. At least one insertion pin 64 inserted into the guide rail GR to guide the movement of the moving body unit 60 and at least one inside wheel 65 and outside wheel 66 fixed in a rotatable manner to roll on the top surface of the support plate 50 are provided on the lower surface of the mounting base 63. The staple binding member 61 is an example of a first postprocessing member, and the stapleless binding member 62 is an example of a second postprocessing member. The staple binding member 61 and the stapleless binding member 62 mounted to the mounting base 63 are arranged as close to each other as possible, so that the distance of relative movement in a binding operation (described below) can be reduced.

Figure 4:
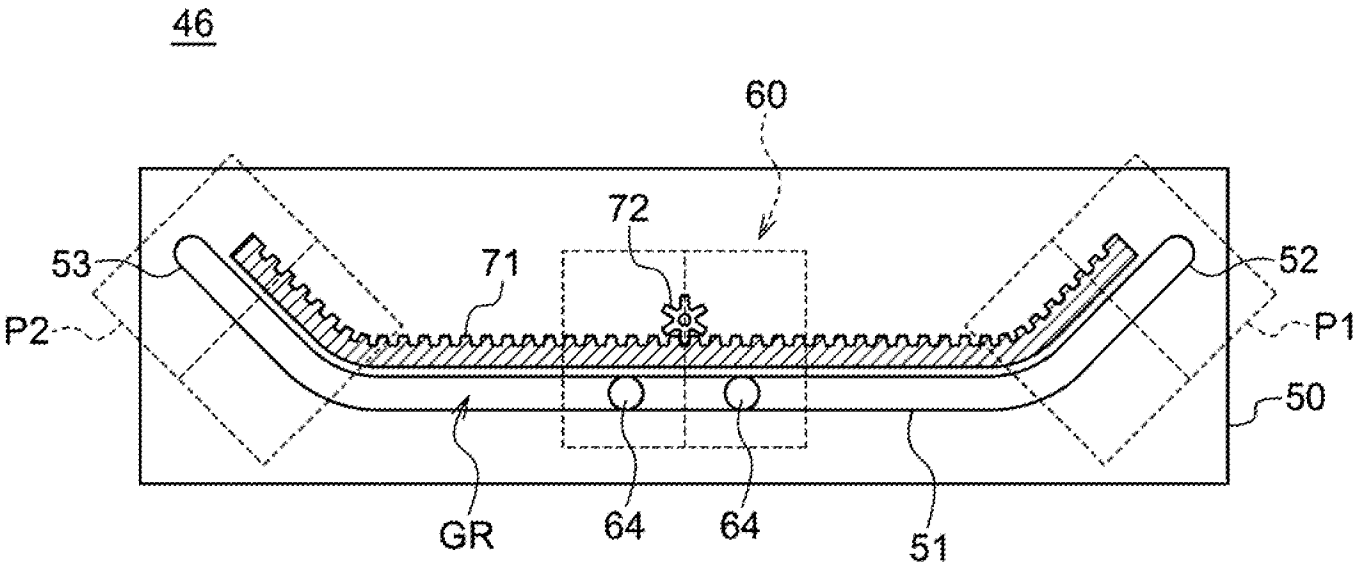
FIG. 4 schematically shows a moving mechanism for the moving body unit shown in FIG. 2.
Figure 5:
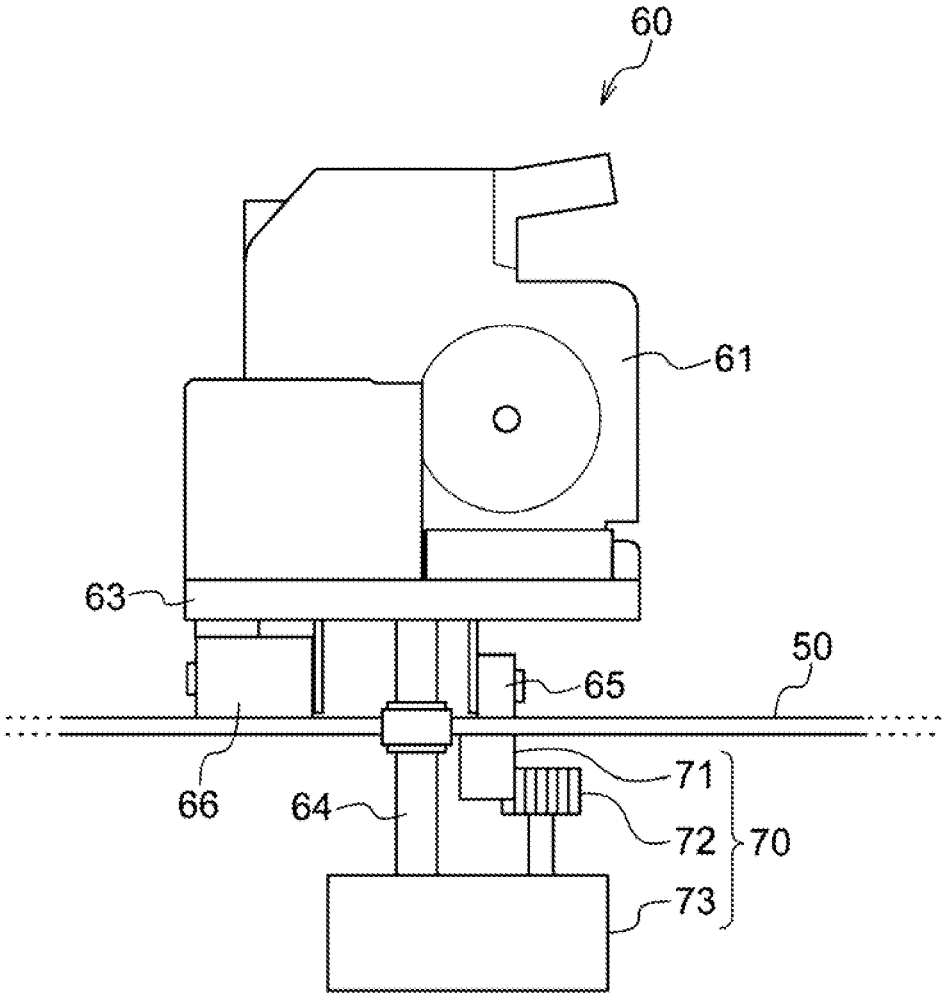
FIG. 5 is a side view of the relevant part of the binding device.

FIG. 4 schematically shows a moving mechanism for the moving body unit 60 shown in FIG. 2, as seen through the support plate 50. FIG. 5 is a side view of the relevant part of the binding device 46. The binding device 46 according to this exemplary embodiment further includes a moving mechanism 70 to move the moving body unit 60 on the support plate 50. As shown in FIGS. 4 and 5, the moving mechanism 70 may include, for example, a rack 71, a pinion 72, and a driving part 73.

The rack 71 has a rack gear provided on the lower surface (back surface) of the support plate 50 so as to extend along the path for the moving body unit 60, that is, the guide rail GR. The rack 71 extends from an intermediate position of the first bent path 52 to an intermediate position of the second bent path 53 of the guide rail GR. The pinion 72 is a pinion gear that meshes with the rack 71. The driving part 73 including a driving source, such as a motor, is fixed to the insertion pin 64 and supplies a driving force to the pinion 72.

The mounting base 63 is moved on the support plate 50 by the moving mechanism 70 in the direction in which the guide rail GR extends. As described above, because the staple binding member 61 and the stapleless binding member 62 are mounted to the mounting base 63, multiple binding members can be moved from one end to the other end of the guide rail GR with the moving mechanism 70. Hence, two postprocessing members can be moved by a common moving mechanism. Because the moving body unit 60 moves the two binding members, 61 and 62, together, the guide rail GR does not need to have a retracting path, which has been needed when the staple binding member 61 and the stapleless binding member 62 are moved independently to retract one of the binding members from the moving path for the other of the binding member.

The moving body unit 60 according to this exemplary embodiment has two insertion pins 64 provided at a distance from each other. With this structure, when the moving body unit 60 is located on the first bent path 52 or the second bent path 53, the moving body unit 60 has been rotated in accordance with the shapes of the bent paths 52 and 53. Thus, it is possible to change the orientations of the staple binding member 61 and/or the stapleless binding member 62 at a first binding position P1 and a second binding position P2 provided on the bent paths 52 and 53. This enables a diagonal binding operation. Although the first and second bent paths 52 and 53 are used to rotate the moving body unit 60 in this exemplary embodiment, the present disclosure is not limited thereto. For example, a rotation mechanism including a restricting member or the like, which comes into contact with a portion of the moving body unit 60 moving along the guide rail GR, thus restricting the movement of the moving body unit 60 and rotating the moving body unit 60, may be provided on the support plate 50. Alternatively, a rotation mechanism including a driving source may be combined with a single insertion pin 64 to rotate the moving body unit 60. The number of the insertion pins may be one, or three or more.

As described above, in the binding unit 40 according to this exemplary embodiment, the staple binding member 61 and the stapleless binding member 62 are moved together by a single moving mechanism 70. Hence, for example, when the moving body unit 60 is disposed at the second binding position P2, the binding positions with the two binding members, 61 and 62, are slightly misaligned in the width direction and the depth direction of the sheet. One method for handling this misalignment may be to modify the shape of the guide rail GR such that the staple binding member 61 and the stapleless binding member 62 can be positioned at the same position and to move the mounting base 63 such that the stopping position of the binding member is changed according to the binding member that performs the binding operation. By modifying the shape of the guide rail GR like this, it is possible to handle the misalignment of the binding positions. However, this makes the shape of the guide rail GR complex and increases the length of the guide rail GR, potentially increasing the size of the support plate 50 and the complexity in machining the guide rail GR. Hence, to handle this misalignment, the binding unit 40 according to this exemplary embodiment has a relative-position adjusting device that adjusts the positions of the staple binding member 61 and the stapleless binding member 62 relative to the sheet P on the loading plate 41. The relative-position adjusting device will be described below.

Figure 6:
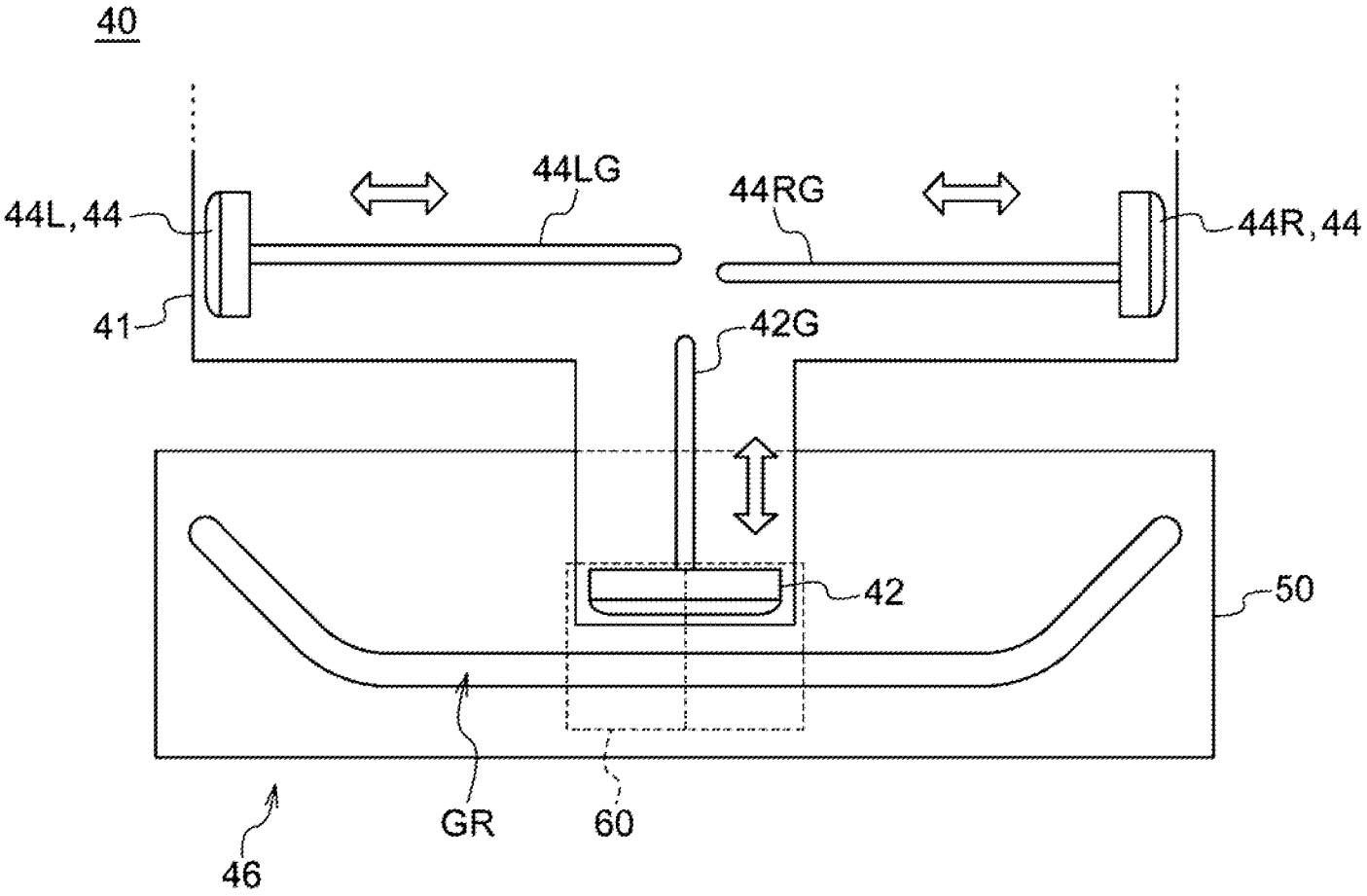
FIG. 6 is a schematic plan view of an example of a relative-position adjusting device of the binding unit.

FIG. 6 shows an example of the relative-position adjusting device of the binding unit 40 and is a schematic plan view showing the relationship between the loading plate 41 without a sheet and the binding device 46. The abutting member 42 and the tampers 44 of the binding unit 40 according to this exemplary embodiment are an example of a recording-medium moving member, serving as the relative-position adjusting device. More specifically, as shown in FIG. 6, the abutting member 42 is attached to the loading plate 41 and is movable in the transport direction, along a slide groove 42G provided in the loading plate 41. The tampers 44 include a left tamper 44L and a right tamper 44R attached near the left edge and the right edge of the loading plate 41, respectively. The left tamper 44L and the right tamper 44R are also movable along a left slide groove 44LG and a right slide groove 44RG provided in the loading plate 41 and extending in the depth direction (also "sheet width direction"). The abutting member 42, the left tamper 44L, and the right tamper 44R are moved by actuators (not shown). The positions of the abutting member 42, the left tamper 44L, and the right tamper 44R may be controlled by using, for example, sheet size information and pulse information from sensors and the actuators provided on the loading plate 41. The abutting member 42, the left tamper 44L, and the right tamper 44R movably attached to the loading plate 41 not only align the sheets P transported to the loading plate 41, but also move the paper bundle PB formed on the loading plate 41 relative to the moving body unit 60.

Figure 7:
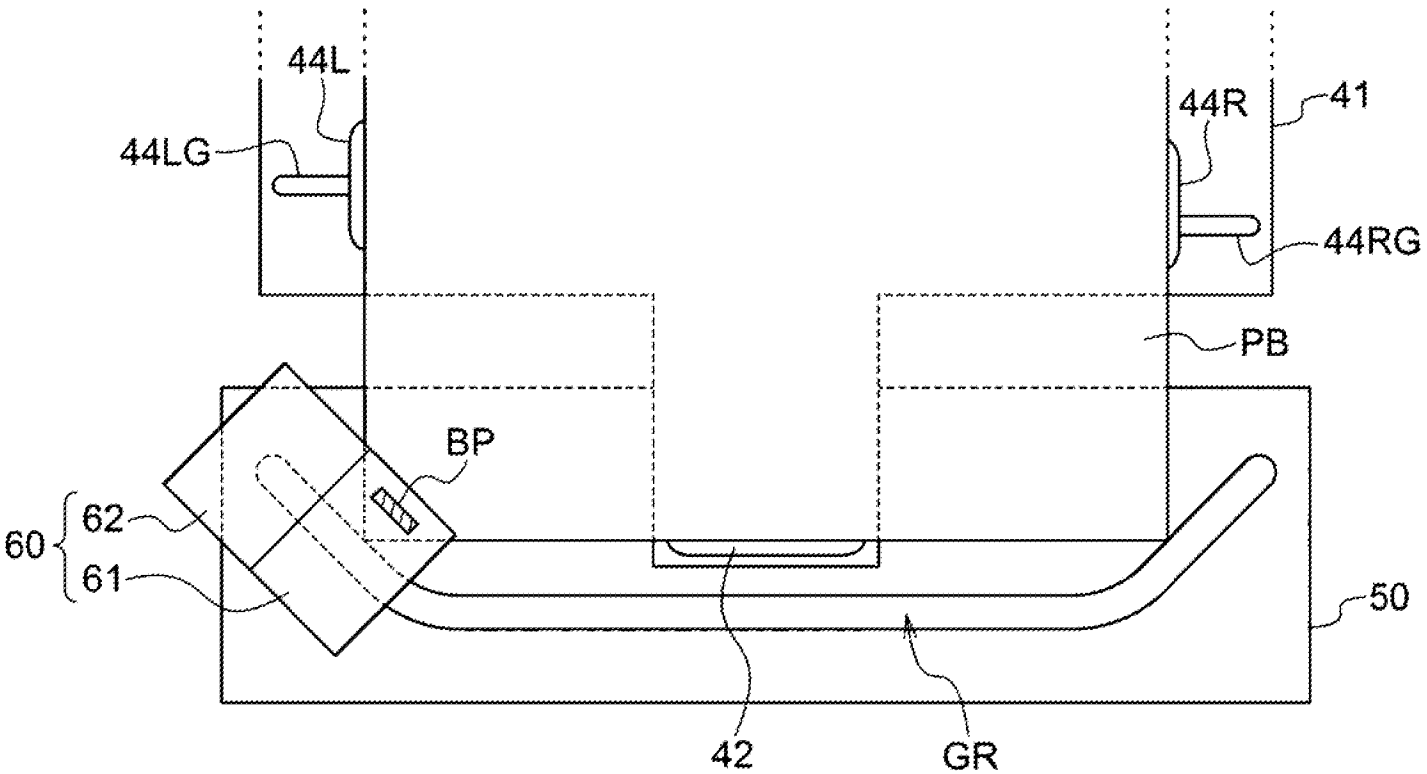
FIG. 7 shows a state in which binding processing has been performed on a paper bundle with a staple binding member, in the binding unit according to the first exemplary embodiment of the present disclosure.

FIG. 7 shows a state in which the binding processing has been performed on the paper bundle PB with the staple binding member 61, in the binding unit 40 according to the first exemplary embodiment of the present disclosure. In the staple binding operation with the binding unit 40 according to this exemplary embodiment, as shown in FIG. 7, the edges of the sheets P transported from the transport path 33 to the loading plate 41 are abutted against the abutting member 42, which is fixed at a first position, by the paddle 43, so that the multiple sheets P (i.e., the paper bundle PB) are aligned in the transport direction. The first position of the abutting member 42 may be set at, for example, a position near the binding device 46, that is, the upstream end of the slide groove 42G in the transport direction. Next, the left tamper 44L and the right tamper 44R located near the edges of the loading plate 41 are moved by the same distance along the left slide groove 44LG and the right slide groove 44RG to align the multiple sheets P in the width direction.

As shown in FIG. 7, once the paper bundle PB is positioned substantially at the center of the loading plate 41 through the above-described operation, the moving body unit 60 is moved to a position where the binding operation is to be performed, for example, the second binding position P2. As shown in FIG. 7, the second binding position P2 is set in advance such that, in a state in which the paper bundle PB is disposed substantially at the center of the loading plate 41, the binding position BP of the paper bundle PB is aligned with the binding position with the staple binding member 61. Accordingly, by performing the binding operation with the staple binding member 61 after the moving body unit 60 is moved to the second binding position P2, the paper bundle PB can be diagonally bound with a staple at the binding position BP set at one corner (left corner in FIG. 7) of the paper bundle PB.

As can be seen from FIG. 7, at the second binding position P2, although the binding position with the staple binding member 61 and the binding position BP of the paper bundle PB are aligned, the corner of the paper bundle PB is not located at the binding position with the stapleless binding member 62. Hence, to bind the paper bundle PB with the stapleless binding member 62 of the moving body unit 60 located at the second binding position P2, the position of the stapleless binding member 62 relative to the paper bundle PB needs to be adjusted.

Figure 8:
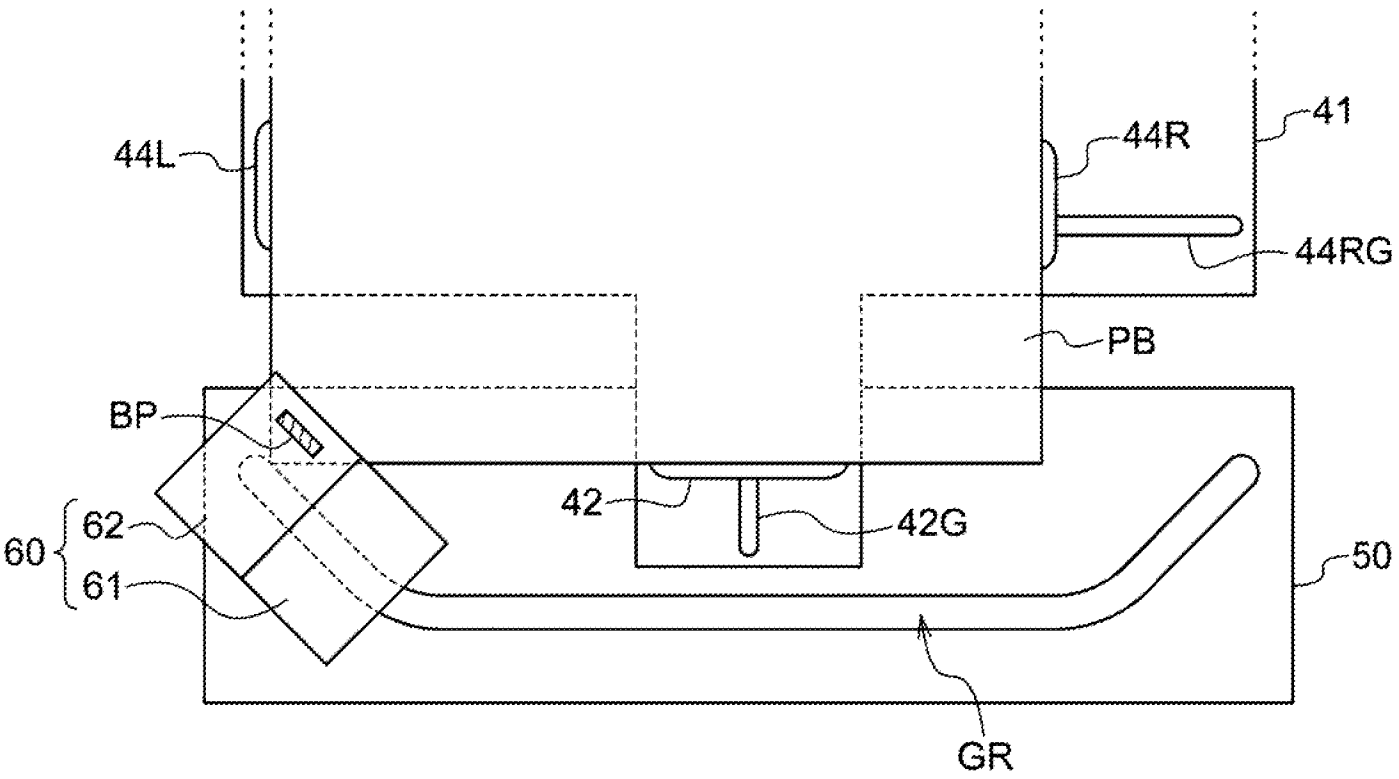
FIG. 8 shows a state in which binding processing has been performed on a paper bundle with a stapleless binding member, in the binding unit according to the first exemplary embodiment of the present disclosure.

FIG. 8 shows a state in which the binding processing has been performed on the paper bundle PB with the stapleless binding member 62, in the binding unit 40 according to the first exemplary embodiment of the present disclosure. In the stapleless binding operation with the binding unit 40 according to this exemplary embodiment, as shown in FIG. 8, the position of the paper bundle PB differs from that in the staple binding operation. More specifically, first, the edges of the sheets P transported from the transport path 33 to the loading plate 41 are abutted against the abutting member 42, which is fixed at a second position different from the first position, by the paddle 43, so that the multiple sheets P (i.e., the paper bundle PB) are aligned in the transport direction. The second position of the abutting member 42 may be set at a position downstream of the first position in the transport direction by taking into consideration the binding position with the stapleless binding member 62 at the second binding position P2. Next, of the left tamper 44L and the right tamper 44R located near the edges of the loading plate 41, only the right tamper 44R is moved along the right slide groove 44RG to align the multiple sheets P in the width direction, at a position near the left tamper 44L. The initial position of the left tamper 44L is set in advance by taking into consideration the binding position with the stapleless binding member 62 at the second binding position P2.

As shown in FIG. 8, once the paper bundle PB is positioned at a leftward position and a downstream position in the transport direction (compared with the position of the paper bundle PB in FIG. 7) of the loading plate 41 through the above-described operation, the moving body unit 60 is moved to the second binding position P2. This second binding position P2 is the same as the second binding position P2 in FIG. 7. However, the paper bundle PB is located at a leftward position and a downstream position in the transport direction, unlike the position thereof in the binding processing in FIG. 7. This position is set in advance such that the binding position BP, set at one corner of the paper bundle PB, and the binding position with the stapleless binding member 62 overlap each other. Accordingly, by performing the binding operation with the stapleless binding member 62 in this state, the paper bundle PB can be diagonally bound without a staple at the binding position BP.

Although these binding operations are performed with the moving body unit 60 located at the second binding position P2, the same binding operation can be performed at another binding position by adjusting the position of the paper bundle PB. More specifically, in the case where the moving body unit 60 is located at the first binding position P1, when the binding operation with the stapleless binding member 62 is to be performed, the paper bundle PB is positioned substantially at the center of the loading plate 41, and when the binding operation with the staple binding member 61 is to be performed, the paper bundle PB is positioned at a rightward position of the loading plate 41 and a downstream position in the transport direction by positioning the abutting member 42 at the second position and moving only the left tamper 44L along the left slide groove 44LG. By doing so, the paper bundle PB can be diagonally bound at the binding position located at another corner (right corner in FIG. 7) of the paper bundle PB.

As described above, in the binding unit 40 according to this exemplary embodiment, the relative position between the paper bundle PB and the binding member that performs the binding operation can be adjusted by moving the paper bundle PB with the abutting member 42 and the tampers 44. Hence, the binding processing can be performed without moving the mounting base 63, regardless of which binding member performs the binding operation. In the above-described binding processing, although the moving body unit 60 is moved after the paper bundle PB is positioned, the order of the positioning and the moving may be changed, or the positioning and the moving may be performed simultaneously. Furthermore, in this exemplary embodiment, although the paper bundle PB is moved by the abutting member 42 and the tampers 44, serving as the recording-medium moving member, the structure is not limited thereto. For example, the paper bundle PB may be moved by making the loading plate 41, including the abutting member 42 and the tampers 44, movable in the transport direction and the sheet width direction.

Furthermore, in the above-described first exemplary embodiment, although the staple binding member 61 and the stapleless binding member 62 are the examples of the first and second postprocessing members, the present disclosure is not limited thereto. For example, instead of these binding members, multiple staple binding members having different types of staples, or a postprocessing member that performs punching may be employed. In the above-described first exemplary embodiment, although only two binding positions, P1 and P2, are shown on the support plate 50, the binding positions are not limited thereto. For example, in addition to the above-described binding positions, a binding position where the paper bundle PB is bound at one or more locations on one side, along the edge to be abutted against the abutting member 42, may be set on the principal guide path 51, or the guide rail GR may extend further along an edge of the paper bundle PB extending in the transport direction, and the binding position may be set at a certain position on this edge.

In the first exemplary embodiment, although the position of the staple binding member 61 and the stapleless binding member 62 relative to the paper bundle PB is adjusted by moving the paper bundle PB, the present disclosure is not limited thereto. In a second exemplary embodiment of the present disclosure described below, the position of the staple binding member 61 and the stapleless binding member 62 relative to the paper bundle PB is adjusted by moving the staple binding member 61 and the stapleless binding member 62.

Second Exemplary Embodiment

Figure 9:
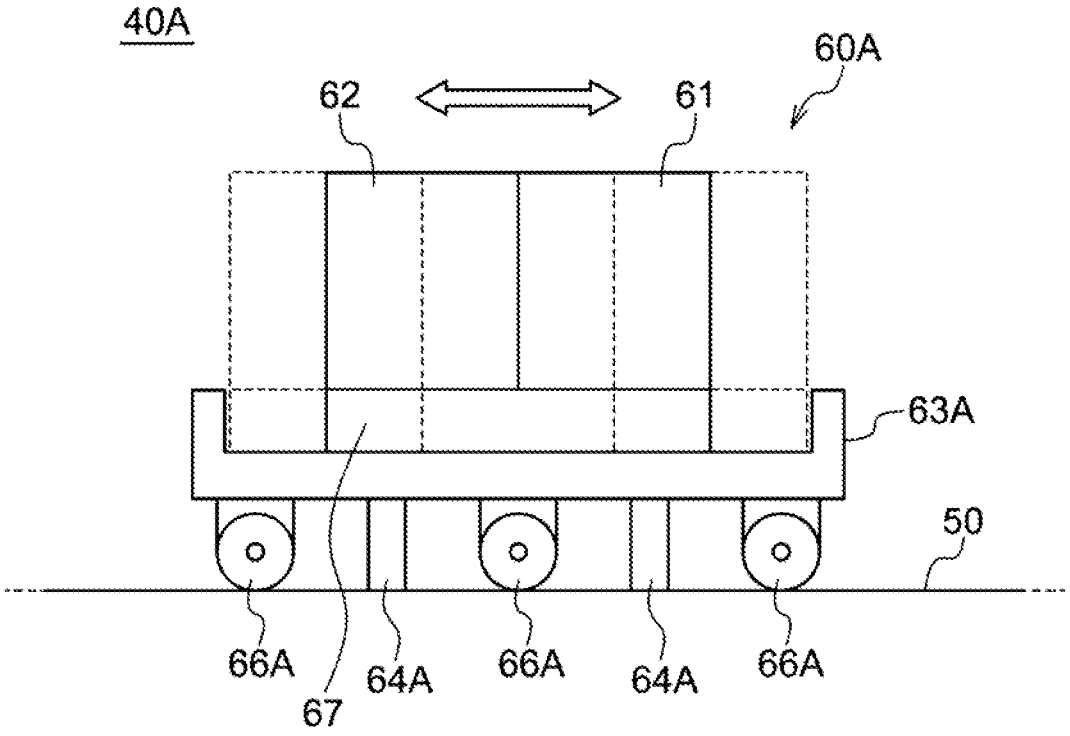
FIG. 9 is a schematic front view showing an example of a moving body unit of a binding unit according to a second exemplary embodiment of the present disclosure.

FIG. 9 is a schematic front view showing an example of a moving body unit of a binding unit 40A according to the second exemplary embodiment of the present disclosure. The postprocessing apparatus and the image forming system according to this exemplary embodiment has the same structure as those according to the first exemplary embodiment, except for the binding unit 40A. Hence, in the description below, the same structures as those of the postprocessing apparatus and the image forming system according to the first exemplary embodiment will be denoted by the same reference signs or the same reference signs with "A" at the ends, and the detailed descriptions thereof will be omitted. The structures different from those in the first exemplary embodiment will be described in a focused manner.

As shown in FIG. 9, in a moving body unit 60A of a binding device 46A included in the binding unit 40A according to this exemplary embodiment, the staple binding member 61 and the stapleless binding member 62 are not directly mounted to the mounting base 63A, but via a movable base 67. The movable base 67 is an example of a relative movement member. The staple binding member 61 and the stapleless binding member 62 are mounted to the top surface of the movable base 67, and the lower surface of the movable base 67 is fixed to an actuator (such as a single axis robot or a linear motor, not shown) provided at least partially in the mounting base 63A. Thus, the movable base 67 is movable on the mounting base 63A. The mounting base 63A is longer than the movable base 67 in the direction in which the staple binding member 61 and the stapleless binding member 62 adjoin. A movable rail 68 (see FIG. 10) that guides the movement of the movable base 67 is formed on the top surface of the mounting base 63A so as to extend in the direction in which the staple binding member 61 and the stapleless binding member 62 adjoin. With this structure, by operating the movable base 67, both the staple binding member 61 and the stapleless binding member 62, which are mounted to the movable base 67, can be positioned at the center of the mounting base 63A in the longitudinal direction.

The movable base 67 moves the staple binding member 61 and the stapleless binding member 62 relative to the mounting base 63A. In this exemplary embodiment, the position of the staple binding member 61 and the stapleless binding member 62 relative to the paper bundle PB is adjusted by the relative movement achieved by the movable base 67. The postprocessing apparatus according to this exemplary embodiment does not have a structure for adjusting the position of the paper bundle PB, so the illustration of the structure for supporting the paper bundle PB is omitted.

Figure 10:
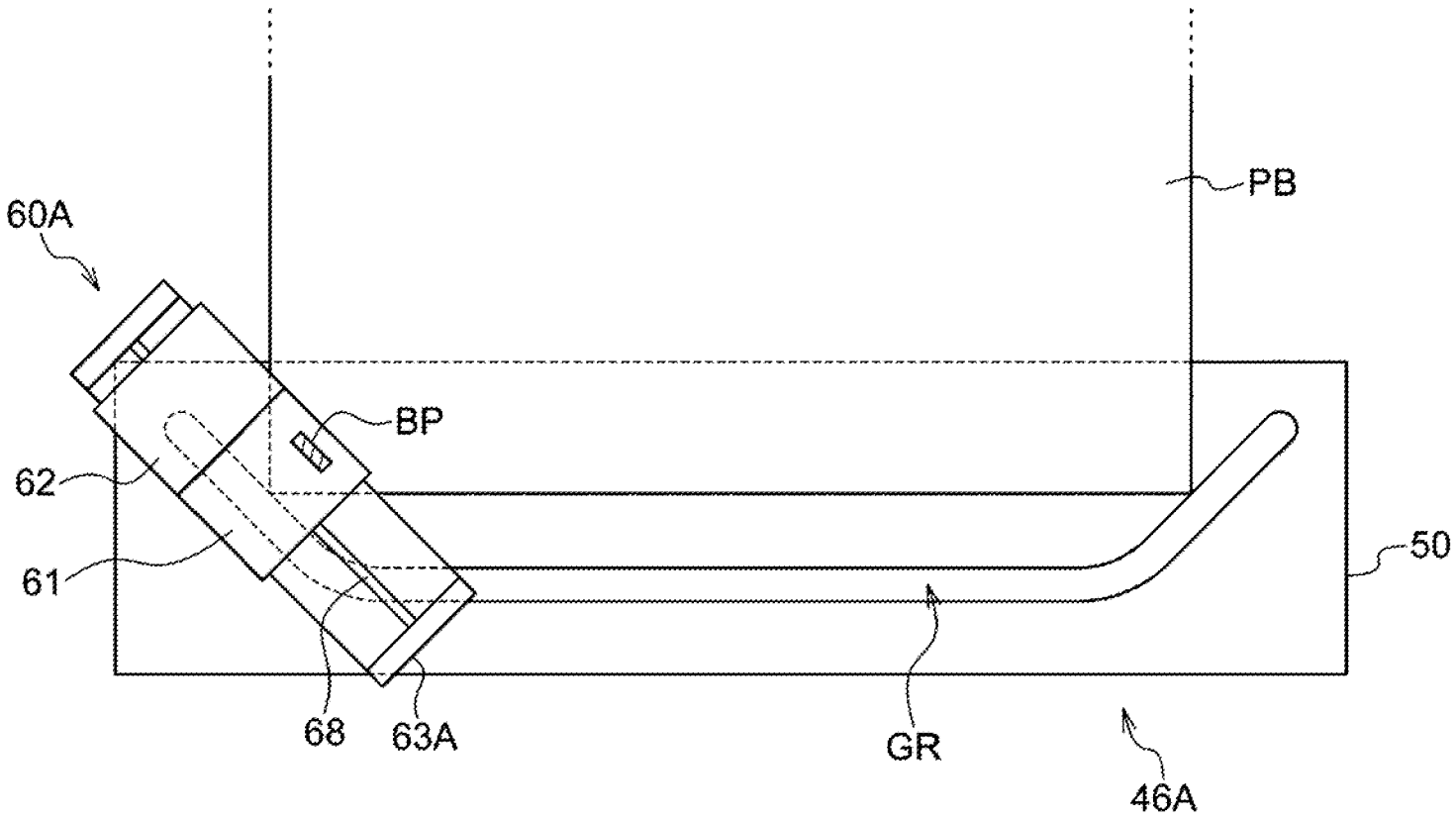
FIG. 10 shows a state in which binding processing has been performed on a paper bundle with a staple binding member, in the binding unit according to the second exemplary embodiment of the present disclosure.

FIG. 10 shows a state in which the binding processing has been performed on the paper bundle PB with the staple binding member 61, in the binding unit 40A according to the second exemplary embodiment of the present disclosure. In the staple binding operation with the binding unit 40A according to this exemplary embodiment, a paper bundle PB is neatly placed on the loading plate 41, and then the moving body unit 60A is moved to a position where the binding operation is to be performed, for example, the second binding position P2. The second binding position P2 is a position set in advance to bind the paper bundle PB at the binding position BP set at one corner (left corner in FIG. 10).

Next, by operating the actuator (not shown) in the mounting base 63A, the movable base 67, to which the staple binding member 61 and the stapleless binding member 62 are mounted, is moved in one direction (left direction in FIG. 9) until the staple binding member 61 is located in the middle of the mounting base 63A in the longitudinal direction. The paper bundle PB on the loading plate 41 according to this exemplary embodiment is positioned such that the binding position with the binding member 61 and the binding position BP of the paper bundle PB overlap each other when the binding member 61 is positioned at this position. Accordingly, by performing the binding operation with the staple binding member 61 after the staple binding member 61 is positioned at this position, the paper bundle PB can be diagonally bound with a staple at the binding position BP.

Figure 11:
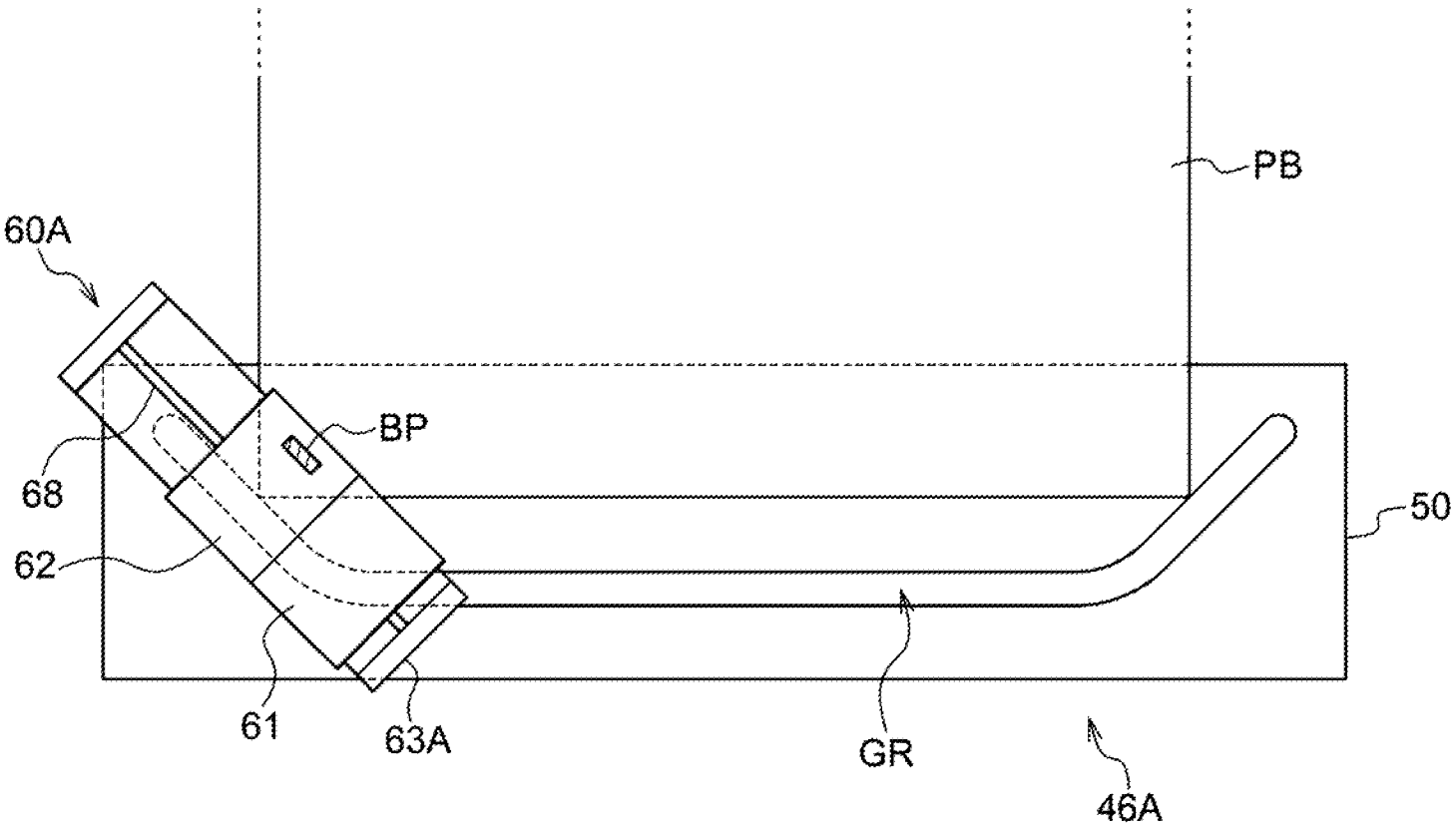
FIG. 11 shows a state in which binding processing has been performed on a paper bundle with a stapleless binding member, in the binding unit according to the second exemplary embodiment of the present disclosure.

FIG. 11 shows a state in which the binding processing is performed on the paper bundle PB with the stapleless binding member 62, in the binding unit 40A according to the second exemplary embodiment of the present disclosure. In the stapleless binding operation with the binding unit 40A according to this exemplary embodiment, first, similarly to the case of the staple binding operation, the moving body unit 60A is moved to the second binding position P2 after the paper bundle PB is neatly placed on the loading plate 41. Next, by operating the actuator in the mounting base 63A, the movable base 67, to which the staple binding member 61 and the stapleless binding member 62 are mounted, is moved in the other direction (right direction in FIG. 9) until the stapleless binding member 62 is located in the middle of the mounting base 63A in the longitudinal direction. As described above, the paper bundle PB on the loading plate 41 according to this exemplary embodiment is positioned such that the binding position with the binding member 62 and the binding position BP of the paper bundle PB overlap each other when the binding member 62 is positioned at this position. Accordingly, by performing the binding operation with the stapleless binding member 62 after the stapleless binding member 62 is positioned at this position, the paper bundle PB can be diagonally bound without a staple at the binding position BP.

As described above, in the binding unit 40A according to this exemplary embodiment, by moving the staple binding member 61 and the stapleless binding member 62 relative to the mounting base 63A with the movable base 67, the relative position between the paper bundle PB and the binding member that performs the binding operation can be adjusted. Hence, the binding processing can be performed without moving the mounting base 63A and the paper bundle PB, regardless of which binding member performs the binding operation. In in this exemplary embodiment, although the movable base 67 is movable in the longitudinal direction of the mounting base 63A, the present disclosure is not limited thereto. For example, the same binding processing can be performed by making the movable base 67 movable not only in the longitudinal direction but also in the transverse direction of the mounting base 63A.

Another Exemplary Embodiment

In the first and second exemplary embodiments, as the structures for adjusting the position of the binding members relative to the paper bundle PB, the structure that moves the paper bundle PB and the structure that moves the binding members have been described. To enable the movement with these movement structures, a space for ensuring the movable range of the paper bundle PB or the binding members is needed. When there is only one type of structure for adjusting the relative position, as in the above-described first and second exemplary embodiments, depending on the internal structure of the postprocessing apparatus or the like, the layout inside the postprocessing apparatus may need to be modified to ensure this space. Hence, taking this point into consideration, in a postprocessing apparatus according to an exemplary embodiment of the present disclosure, the above-described relative-position adjusting devices may be combined. A postprocessing apparatus including multiple relative-position adjusting devices will be briefly described below as another exemplary embodiment of the present disclosure.

In a binding unit of the postprocessing apparatus according to this exemplary embodiment, a paper bundle PB can be moved relative to the staple binding member 61 and the stapleless binding member 62, and the staple binding member 61 and the stapleless binding member 62 can be moved relative to the paper bundle PB. The structure for moving the paper bundle PB may be, for example, the structure described in the first exemplary embodiment, which uses the abutting member 42 and the tampers 44. The structure for moving the staple binding member 61 and the stapleless binding member 62 may be, for example, the structure described in the second exemplary embodiment, which uses the movable base 67.

Adjusting the position of the binding members relative to the paper bundle PB with multiple mechanisms as in the postprocessing apparatus according to this exemplary embodiment has various advantages. Specifically, because the operation for moving the paper bundle PB and the binding members to specific relative positions is performed by two moving mechanisms, the moving distance with each moving mechanism is reduced to about half, compared with a case where the operation is performed with one moving mechanism.

Because this reduces the movable range required by each moving mechanism, the space can be easily obtained in the postprocessing apparatus. Furthermore, when there is one moving mechanism, the movement in two directions, i.e., the sheet width direction and the transport direction, needs to be performed by the one moving mechanism. However, when there are multiple moving mechanisms as in this exemplary embodiment, by making the moving mechanisms move in different directions, the movable range of each moving mechanism can be reduced. For example, the paper bundle PB is moved only in the sheet width direction (an example of a first direction) with the tampers 44, and the adjustment of the relative position in the transport direction (an example of a direction perpendicular to the first direction) is performed with the movable base 67, serving as a structure for moving the binding members. In this case, because only the tampers 44 are needed as the movement structure for moving the paper bundle PB, the required movable range is smaller than that in the case where the abutting member 42 is also needed as the movement structure. In addition, because the abutting member 42 does not need to be moved, the structure thereof can be made simple.

In this exemplary embodiment, although the movable base 67 that can move relative to the mounting base 63A is used as the structure for moving the staple binding member 61 and the stapleless binding member 62, the structure is not limited thereto, as long as the staple binding member 61 and the stapleless binding member 62 can be moved relative to the paper bundle PB. For example, the staple binding member 61 and the stapleless binding member 62 may be moved by making the overall binding device 46 movable relative to the paper bundle PB.

Furthermore, in the above-described exemplary embodiments, although the staple binding member 61 and the stapleless binding member 62 are mounted side-by-side to the mounting base 63 or the movable base 67, the present disclosure is not limited thereto. For example, portions of the components of the staple binding member 61 and the stapleless binding member 62, such as driving sources for performing the binding operation and the housings of the members, may be shared. In particular, when the components are shared, the binding position with the staple binding member 61 and the binding position with the stapleless binding member 62 may be set close to each other. In association with this, a postprocessing apparatus and an image forming system according to an exemplary embodiment of the present disclosure do not need to have the above-described relative movement member. For example, when the binding positions with the binding members are sufficiently close to each other, binding operations can be performed without moving the paper bundle or the binding members relative to the other. Similarly, a postprocessing apparatus and an image forming system according to an exemplary embodiment of the present disclosure do not need to have the above-described rotation member. For example, in a postprocessing apparatus that performs only one-side binding along an edge of a paper bundle with the binding member, the moving body unit does not need to be rotated.

The present disclosure is not limited to the above-described exemplary embodiments but may be variously modified without departing from the scope of the present disclosure. Such modifications are all included in the technical idea of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A postprocessing apparatus comprising:

a first postprocessing member that performs postprocessing on a recording medium;

a second postprocessing member that differs from the first postprocessing member and performs postprocessing on the recording medium;

a mounting base to which the first and second postprocessing members are mounted;

a support plate having a guide member that guides movement of the mounting base;

a moving mechanism that moves the mounting base along the guide member; and a relative-position adjusting device that adjusts positions of the first and second postprocessing members relative to the recording medium, wherein the relative-position adjusting device includes a relative movement member that is provided between the mounting base and the first and second postprocessing members and moves the first and second postprocessing members relative to the mounting base.

2. The postprocessing apparatus according to claim 1, further comprising a rotation member that rotates the mounting base on the support plate.

3. The postprocessing apparatus according to claim 1, wherein the relative-position adjusting device includes a recording-medium moving member that moves the recording medium.

4. The postprocessing apparatus according to claim 1, wherein the relative-position adjusting device includes a recording-medium moving member that moves the recording medium in a first direction, and a relative movement member that is provided between the mounting base and the first and second postprocessing members and moves the first and second postprocessing members relative to the mounting base in a second direction including a direction perpendicular to the first direction.

5. An image forming system comprising:

an image forming apparatus that transports a recording medium and forms an image on the recording medium; and the postprocessing apparatus according to claim 1, which is provided downstream of the image forming apparatus in a transport direction of the recording medium.

6. A postprocessing apparatus comprising:

a first postprocessing member that performs postprocessing on a recording medium;

a second postprocessing member that differs from the first postprocessing member and performs postprocessing on the recording medium;

a mounting base to which the first and second postprocessing members are mounted;

a support plate having a guide member that guides movement of the mounting base;

a moving mechanism that moves the mounting base along the guide member; and a relative-position adjusting device that adjusts positions of the first and second postprocessing members relative to the recording medium, wherein the relative-position adjusting device includes a recording-medium moving member that moves the recording medium in a first direction, and a relative movement member that is provided between the mounting base and the first and second postprocessing members and moves the first and second postprocessing members relative to the mounting base in a second direction including a direction perpendicular to the first direction.

7. A postprocessing apparatus comprising:

first postprocessing means for performing postprocessing on a recording medium;

second postprocessing means, different from the first postprocessing means, for performing postprocessing on the recording medium;

a mounting base to which the first postprocessing means and the second postprocessing means are mounted;

a support plate having a guide member that guides movement of the mounting base; and a moving mechanism that moves the mounting base along the guide member, a relative-position adjusting means that adjusts positions of the first and second postprocessing members relative to the recording medium, wherein the relative-position adjusting means includes a relative movement member that is provided between the mounting base and the first and second postprocessing members and moves the first and second postprocessing members relative to the mounting base.

* * * * *